US006836100B2

(12) United States Patent
Egan et al.

(10) Patent No.: US 6,836,100 B2
(45) Date of Patent: Dec. 28, 2004

(54) METHOD AND PHASE REDUNDANT REGULATOR APPARATUS FOR IMPLEMENTING REDUNDANCY AT A PHASE LEVEL

(75) Inventors: Patrick Kevin Egan, Rochester, MN (US); Steven Dennis Keidl, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 60 days.

(21) Appl. No.: 10/438,398

(22) Filed: May 15, 2003

(65) Prior Publication Data

US 2004/0227495 A1 Nov. 18, 2004

(51) Int. Cl.[7] ..... G05F 1/59
(52) U.S. Cl. ..... 323/272; 323/285
(58) Field of Search ..... 323/272, 282, 323/284, 285

(56) References Cited

U.S. PATENT DOCUMENTS 4,074,182 A * 2/1978 Weischedel ..... 323/269
5,122,726 A * 6/1992 Elliott et al. ..... 323/272
5,491,786 A 2/1996 Egan et al. ..... 395/180
6,198,261 B1 * 3/2001 Schultz et al. ..... 323/272
6,232,754 B1 * 5/2001 Liebler et al. ..... 323/272
6,362,608 B1 * 3/2002 Ashburn et al. ..... 323/272
6,414,470 B1 * 7/2002 Liu et al. ..... 323/272
6,515,460 B1 * 2/2003 Farrenkopf ..... 323/272
6,771,052 B2 * 8/2004 Ostojic ..... 323/266

* cited by examiner

*Primary Examiner*—Jeffrey Sterrett
(74) *Attorney, Agent, or Firm*—Joan Pennington

(57) ABSTRACT

A plurality of regulator phases are connected in parallel between a regulator input and a regulator output, each phase including a regulator receiving an input voltage and providing an output voltage. A multi-phase controller is coupled to each of the plurality of regulator phases, where one or more phases are provided for enabling redundancy. The multi-phase controller receives a feedback output voltage and a respective detected current signal from each of the plurality of regulator phases. The multi-phase controller generates control signals to sequentially activate each of the plurality of regulator phases for predetermined periods of time to generate controlled current sharing between phases. To achieve redundancy at a phase level, each of the plurality of regulator phases includes an output ORing device to limit reverse current flow into each phase and an input protection device for providing input over current protection and output over voltage protection of each phase. A current sharing method maintains current sharing between the active phases after a failure of one or more phases with one or more phases provided for enabling redundancy.

20 Claims, 10 Drawing Sheets

PRIOR ART

PRIOR ART

PRIOR ART

PRIOR ART

PRIOR ART

PRIOR ART

PRIOR ART

METHOD AND PHASE REDUNDANT REGULATOR APPARATUS FOR IMPLEMENTING REDUNDANCY AT A PHASE LEVEL

FIELD OF THE INVENTION

The present invention relates generally to the data processing field, and more particularly, relates to a method and a phase redundant regulator apparatus for implementing redundancy at a phase level.

DESCRIPTION OF THE RELATED ART

As the demand for reliability of electronic equipment and other hardware increases, the use of redundancy in regulator designs advantageously may be implemented. Various regulator arrangements are known in the art.

For example, FIG. 1 illustrates a known regulator design, a conventional buck regulator topology. The conventional buck regulator typically includes a pair of field effect transistors (FETs) Q1, Q2, a control module M1, an input capacitor C1, an output capacitor C2, and an inductor L1 coupled in series between FET Q1 and the output voltage Vout. An input voltage Vin is converted to an output voltage Vout by controlling the on time of FET Q1 and the off time FET Q2 using the control module M1 that receives the output voltage Vout feedback and provides a control or gate input to each of the FETs Q1, Q2.

FIG. 2 illustrates a typical multi-phase buck regulator arrangement. As output currents have increased, multi-phase controllers have been increasingly used. The illustrated multi-phase buck regulator basically includes three buck converters that would be controlled by having their gate drive signals generated 120 degrees apart. The three buck converters are controlled out of phase from each other by the common control module M1. Controlling the three buck converters out of phase generally improves both input and output ripple current, ripple and response time.

FIG. 3A shows a prior art multi-phase buck regulator arrangement with the buck regulators connected in parallel. It is also common that the buck or other regulator and multi-phase regulators may be connected in parallel. This parallel arrangement has been provided to increase the available output current, but not for redundant operation. The prior art multi-phase buck regulator arrangement is not effective as a redundant configuration for the following reasons. First, shorts of the off-time FET Q2 or output capacitor C2 will bring down the output. Second, shorts of the on-time FET Q1 results in over voltage of the output voltage and an over current of the input voltage source. Third, shorts of the input capacitor C1 will also cause an over current of the input voltage source. FIGS. 4–6 illustrate conventional arrangements to handle the above listed problems at a regulator level. Fourth, an average current share method typically is provided for a multiple regulator system, such as the illustrated multi-phase buck regulator arrangement of FIG. 3A. However, the average current share method does not work for redundant regulator systems. With an average current share method, each regulator phase is to run at the load current divided by the number of regulator phases, but when one fails the average includes the failed unit so current sharing between the remaining ones fails.

Referring also to FIG. 3B, each of the multi-phase controllers M1 of FIG. 3A generates control signals to sequentially activate each of the plurality of regulator phases 1–3 for predetermined periods of time to generate controlled current sharing output current pulses on a periodic basis. Multi-phase controller M1 provides respective gate drive signals applied to each of the multi-phases FETs. Gate drive Q1A is applied to FET Q1A, gate drive Q2A is applied to FET Q2A; gate drive Q1B is applied to FET Q1B, gate drive Q2B is applied to FET Q2B; gate drive Q1C is applied to FET Q1C, and gate drive Q2C is applied to FET Q2C. As shown this is a three-phase design where the gate drives between phases are 120 degrees out of phase. Also the inductor currents of each of the phases are shown as, IL1A, IL1B, and IL1C, where each phase supplies one third of the load current and has AC current component that is 120 degrees out of phase from the other phases.

FIG. 4 shows a respective ORing device or diode D1, D2 with the illustrated two regulators to prevent the output voltage going down due to a short of the off-time FET Q2 or output capacitor C2. Alternatively, a FET is often used instead of a diode. When an ORing FET is used negative current detection/protection is required to make the FET work like a true diode and only allows current to flow out of the regulator and not into the regulator.

FIG. 5 shows a traditional circuit for protection of shorts of the on-time FET Q1 from causing over voltage (OV) of the output voltage. This is done by sensing the output voltage and firing an SCR, X1, to short the input and blow an input fuse F1. This arrangement works to protect the output load, but fuses are generally slow and will most likely cause the system to shut down due to an over current fault on the power supply that supplies the input voltage.

FIG. 6 shows a prior art circuit that has been used for over voltage protection to replace the fuse circuit of FIG. 5 that works at greater speed. In FIG. 6, the fuse F1 is replaced by a third FET Q3 with a latch activated by an over voltage detect that provides a control or gate input to turn off FET Q3 and open the input voltage Vin.

FIG. 7 illustrates a conventional arrangement of multiple regulators, REG 1, REG 2, and REG 3 in a N+1 redundant fashion, where N is the number of regulators required to satisfy a required system capacity and one extra regulator is provided for redundant operation. Initially each of the three regulators REG 1, REG 2, and REG 3 operate at ⅔ capacity. When one of the three regulators fails, such as REG 1, then the remaining regulators, REG 2, and REG 3 operate at full capacity to satisfy the required system capacity. For example, with a system capacity of 200 amps, three regulators each having 100 amp capacity are used.

The problem of current sharing in redundant systems is addressed by using another current share method rather than the average current share. Other known current sharing methods include a master-slave current share method, where the regulator that supplies the highest current controls the bus and other regulators are adjusted upwardly. An impedance current share has been used where tight regulation is required and current share is based on system impedance. Also a common error voltage has been used for current mode controlled regulators.

As shown in FIG. 7, ORing devices, D1, D2, and D3 are used on the respective regulator outputs, and a master/slave current share method is used with a fuse or FET protection method used for over voltage protection. It should be noted that a FET protection circuit, though known, has not been used for redundant operation, but as replacement for the slower fuse method. Other redundant designs may use isolated topologies where shorts of the FETs cannot cause over voltage and these circuits are not required.

A need exists for an improved mechanism for implementing redundancy in regulator designs.

SUMMARY OF THE INVENTION

A principal object of the present invention is to provide a method and a phase redundant regulator apparatus for implementing redundancy in regulator designs. Other important objects of the present invention are to provide such method for implementing redundancy in regulator designs and phase redundant regulator apparatus substantially without negative effect and that overcome many of the disadvantages of prior art arrangements.

In brief, a method and a phase redundant regulator apparatus are provided for implementing redundancy in regulator designs. A plurality of regulator phases are connected in parallel between a regulator input and a regulator output, each of the plurality of regulator phases including a regulator receiving an input voltage and providing an output voltage. A multi-phase controller is coupled to each of the plurality of regulator phases. The multi-phase controller receives a feedback output voltage and a respective detected current signal from each of the plurality of regulator phases. The multi-phase controller generates control signals to sequentially activate each of the plurality of regulator phases for predetermined periods of time to generate controlled current sharing between phases. Each of the plurality of regulator phases includes an output ORing device to limit reverse current flow into each of the phase outputs, an input protection device for providing input over current protection and output over voltage protection of each phase, and a current sharing method for maintaining current sharing between all active phases after a failure of one or more regulator phases with one or more regulator phases provided for enabling redundancy.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 7:
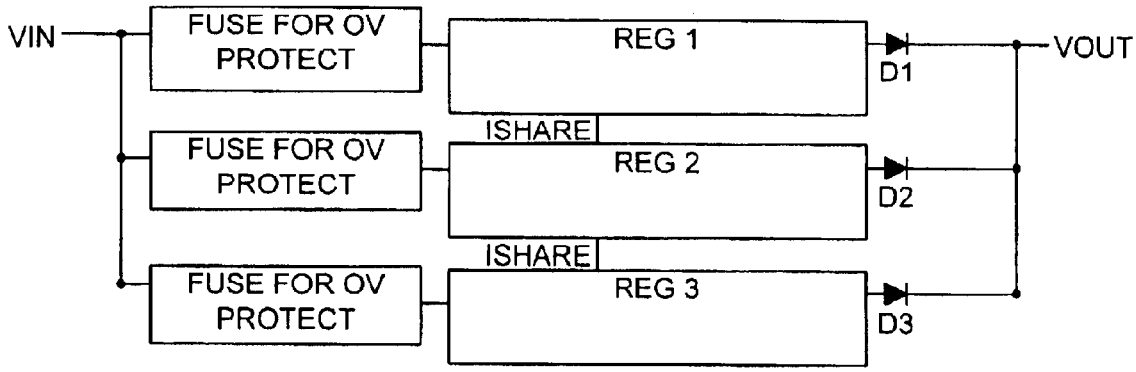
FIG. 7 is a schematic and block diagram representation illustrating a conventional redundant regulator arrangement.

In accordance with features of the preferred embodiment, a multi-phase regulator arrangement is used for implementing redundancy at a phase level. Phase redundancy of the preferred embodiment enables redundancy on a smaller level than the prior art redundancy from regulator to regulator as shown in FIG. 7. Phase redundancy of the preferred embodiment can be used to implement redundancy on a single assembly. Redundancy can be provided at a much lower cost than prior art redundancy arrangements. The phase redundancy of the preferred embodiment effectively creates a higher reliability regulator.

Figure 8:
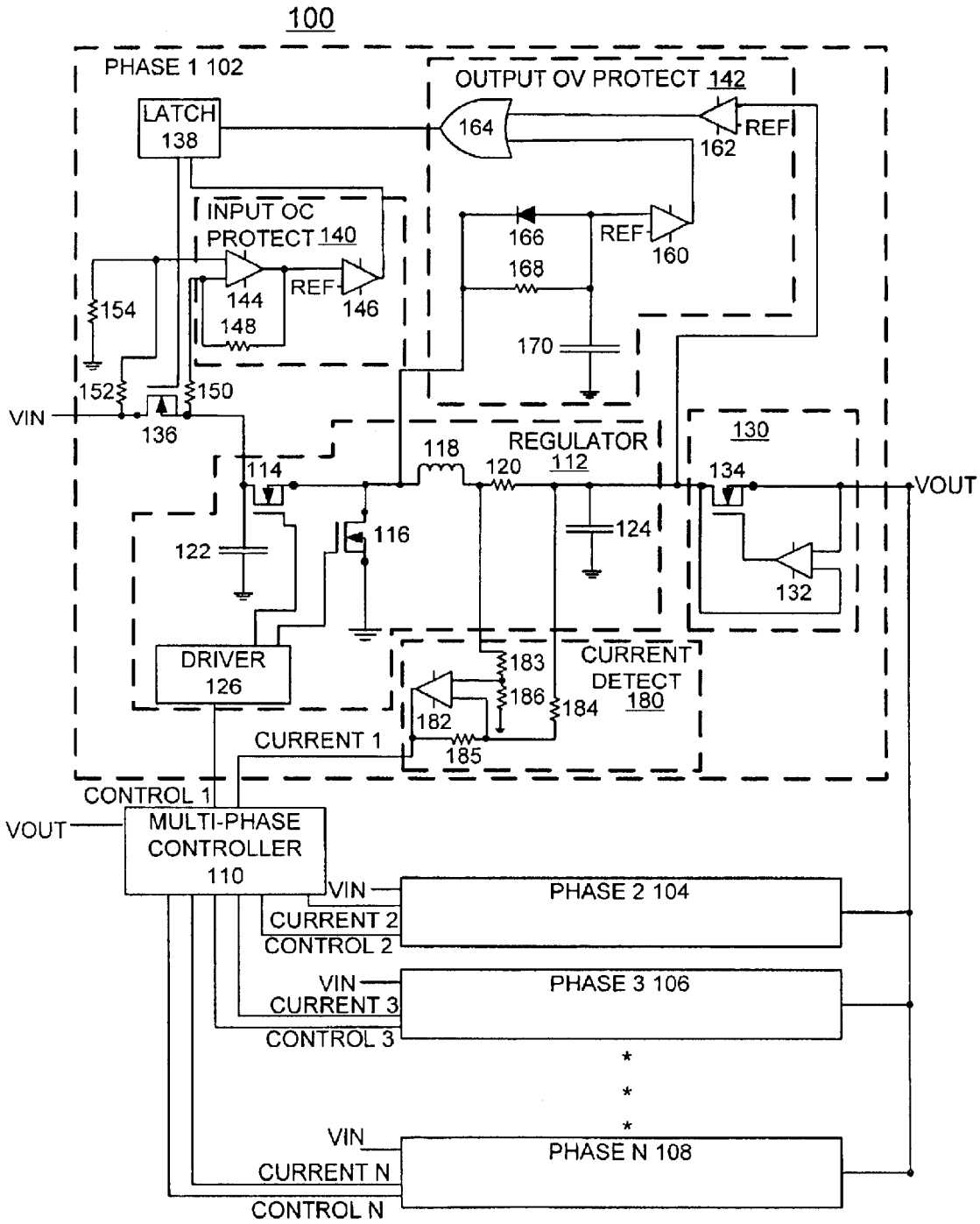
FIG. 8 is a schematic and block diagram representation illustrating a phase redundant regulator apparatus in accordance with the preferred embodiment.

Having reference now to the drawings, in FIG. 8, there is shown a multi-phase regulator system generally designated by the reference character 100 for implementing a phase redundancy method in accordance with the preferred embodiment. Multi-phase regulator system 100 includes a plurality of substantially identical phases or multi-phases, phase 1, 102, phase 2, 104; phase 3, 106; and phase N, 108 connected in parallel between a regulator input VIN and a regulator output VOUT with a multi-phase controller 110 connected to and operatively controlling each of the multi-phases.

Multi-phase regulator system 100 includes a selected number N of phases, for example, twenty-two phases operating redundantly, with two failed phases, the non-failed twenty phases providing a required system capacity.

Each of the multi-phases, phase 1, 102; phase 2, 104; phase 3, 106; and phase N. 108 includes the same components, while only phase 1, 102 is shown in detail in FIG. 8. An input voltage VIN is applied to each of the multi-phases, phase 1, 102; phase 2, 104; phase 3, 106; and phase N, 108 and converted to an output voltage VOUT by a regulator generally designated by the reference character 112.

The multi-phase controller 110 receives a feedback output voltage VOUT. A respective detected current signal is applied to the multi-phase controller 110 from each of the multi-phases, phase 1, 102, phase 2, 104; phase 3, 106; and phase N, 108 indicated at a respective line CURRENT 1, CURRENT 2, CURRENT 3, and CURRENT N. The respective detected current signals are provided by a current detect included within the regulator 112 each of the multi-phases, phase 1, 102, phase 2, 104; phase 3, 106; and phase N, 108.

Figure 9:
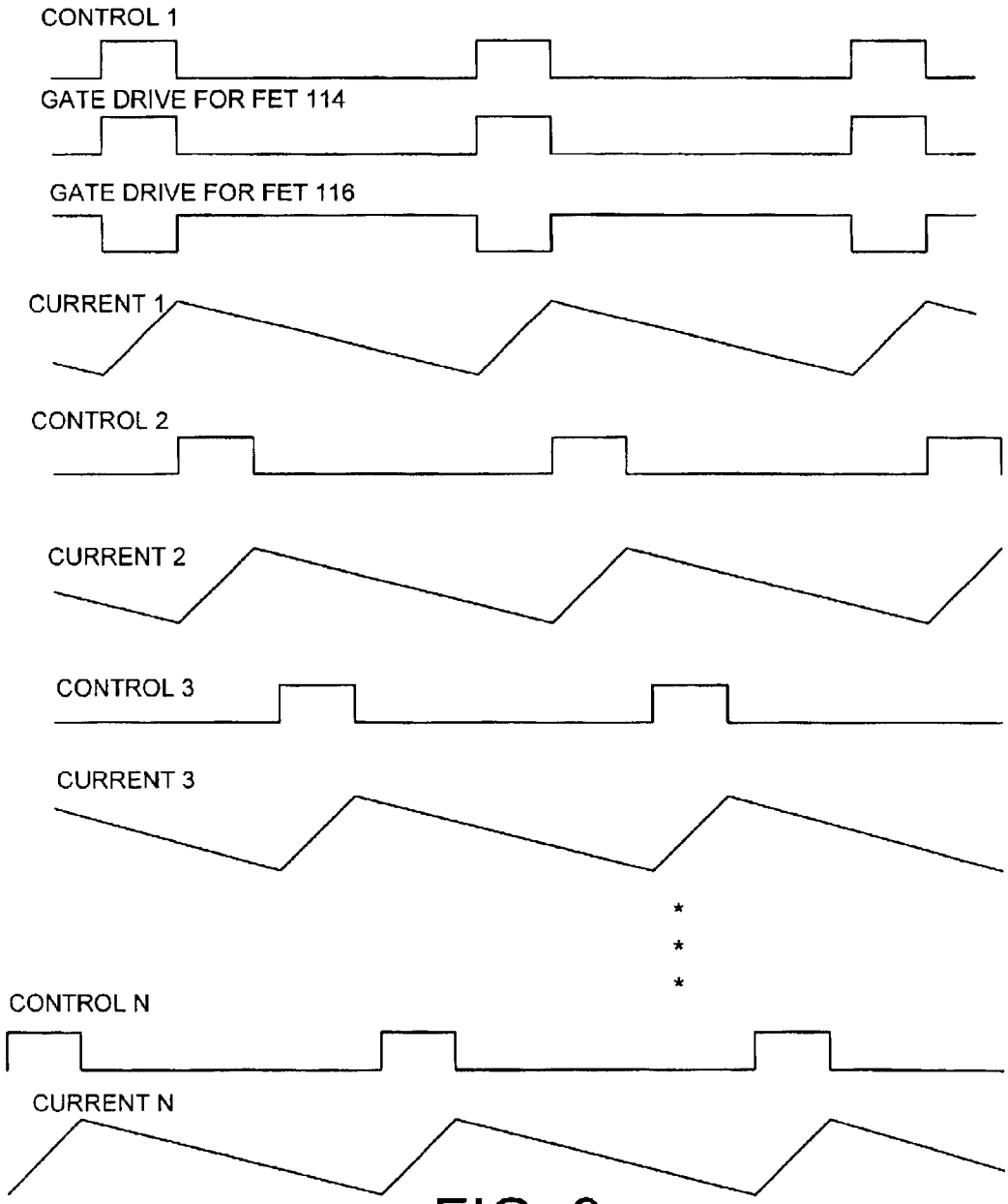
FIG. 9 is a timing diagram illustrating activation of multiple phases of the phase redundant regulator apparatus of FIG. 8 in accordance with the preferred embodiment.

Referring also to FIG. 9, multi-phase controller 110 generates control signals to sequentially activate each of the plurality of regulator phases 1-N for predetermined periods of time to generate controlled current sharing output current pulses on a periodic basis. Multi-phase controller 110 provides a respective control signal applied to each of the multi-phases, phase 1, 102, phase 2, 104; phase 3, 106; and phase N, 108 indicated at a respective line CONTROL 1, CONTROL 2, CONTROL 3, and CONTROL N in FIG. 9. A respective phase for each of the multi-phases, phase 1, 102, phase 2, 104; phase 3, 106; and phase N, 108 is controlled by multi-phase controller 110, as illustrated in FIG. 9.

It should be understood that the present invention is not limited to a particular current sharing method, various current sharing methods meet the requirement of maintaining current sharing between the non-failed phases when a phase fails. For example, the master/slave current sharing method where the highest current phase would control and the slaves would be adjusted up to this current. In this case the failed phase would provide zero current so it would not be the master and could not be adjusted up. But, the master would still control and the other slaves would be adjusted up to the current level of the master. Other acceptable current share methods, such as common error voltage and impedance or droop methods alternatively can be provided.

Each of the multi-phases 1-N includes a regulator generally designated by the reference character 112. In FIG. 8, a buck regulator topology is shown for regulator 112; however, it should be understood that the present invention is not limited to this topology. One of various different regulator or converter arrangements can be used in the multi-phase regulator system 100 for implementing a phase redundancy method in accordance with the preferred embodiment.

Buck regulator 112 includes a pair of field effect transistors (FETS) 114, 116 with an inductor 118 and a resistor 120 coupled in series between FET 114 and the output voltage Vout. The buck regulator 110 includes an input capacitor 122, an output capacitor 124, a driver module 126, and resistor 120 coupled between inductor 118 and output capacitor 124. The input voltage Vin is converted to the output voltage Vout by controlling the on time of FET 114 and the off time FET 116 using the driver module 126 that receives the respective control signal from the multi-phase controller 110 and provides a control or gate input to each FET 114, 116. It should be understood that the function of driver module 126 could be integrated into the multi-phase controller 110.

Figure 1:
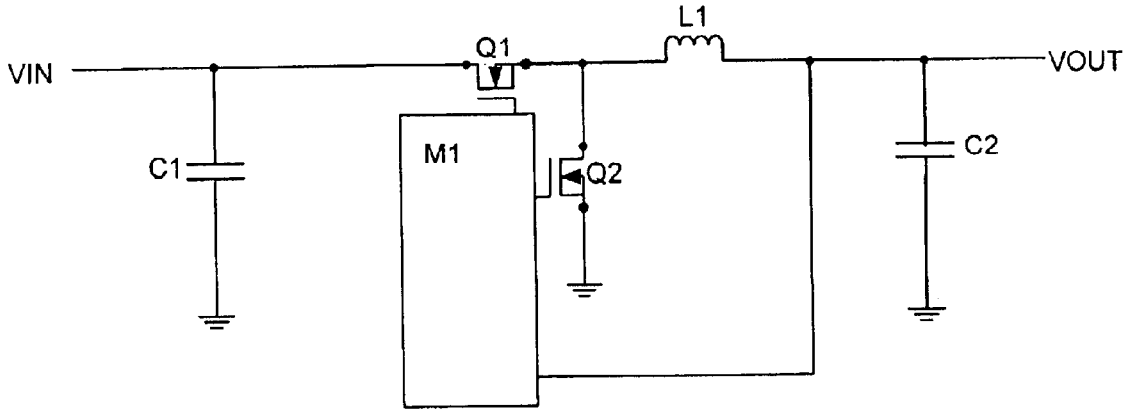
FIG. 1 is a schematic and block diagram representation illustrating a conventional buck regulator topology.
Figure 2:
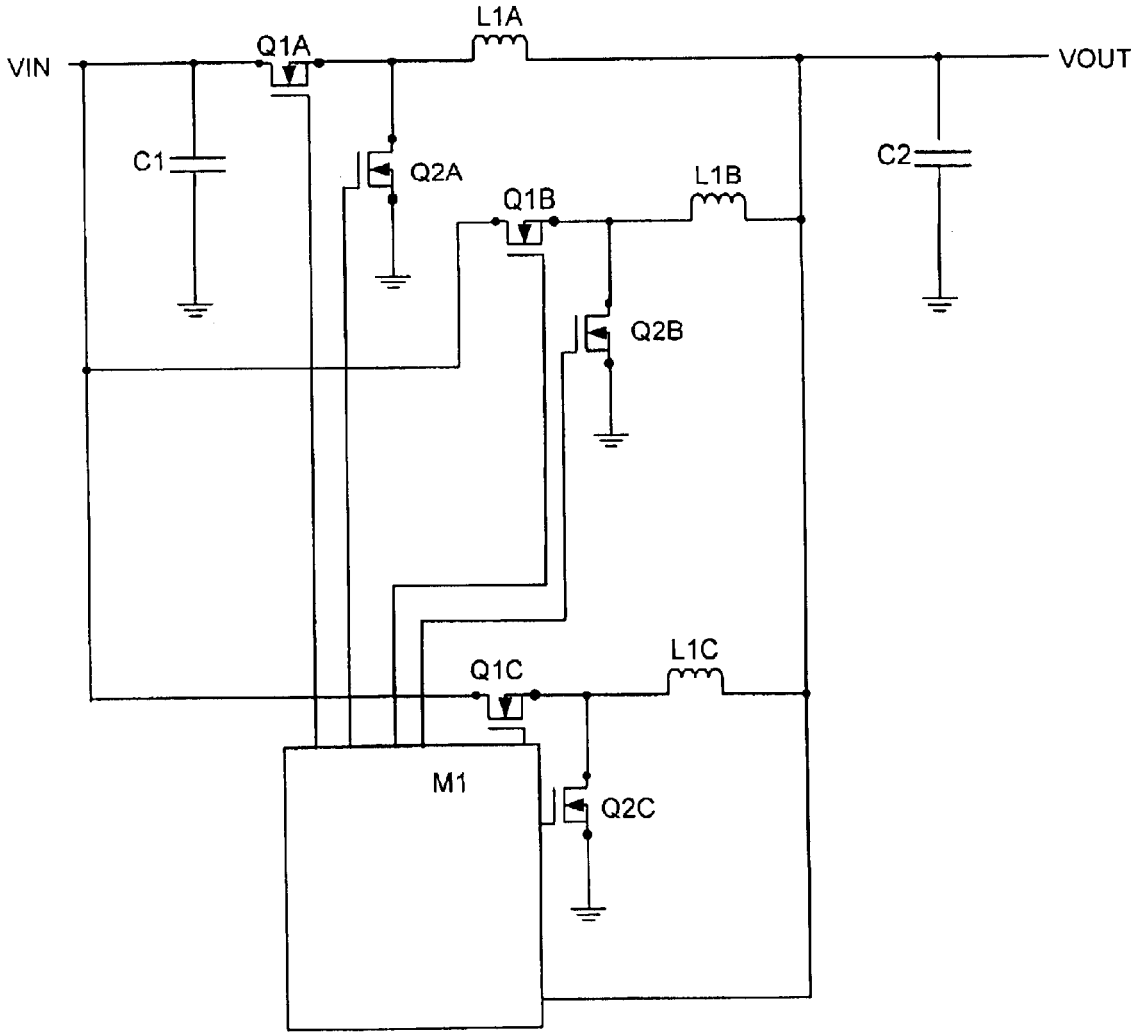
FIG. 2 is a schematic and block diagram representation illustrating a conventional multi-phase buck regulator arrangement.
Figure 3A:
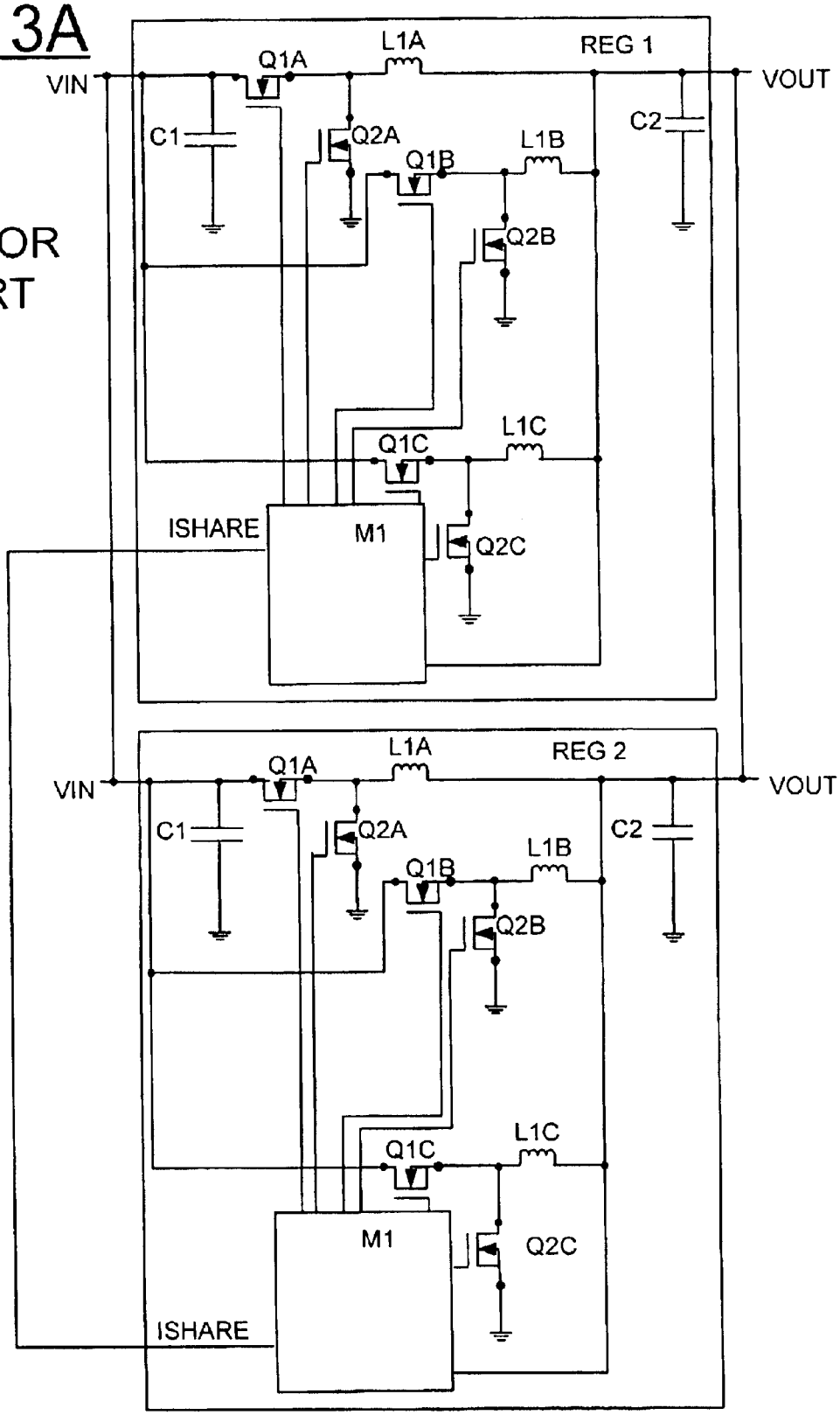
FIG. 3A is a schematic and block diagram representation illustrating a conventional parallel multi-phase buck regulator arrangement.
Figure 3B:
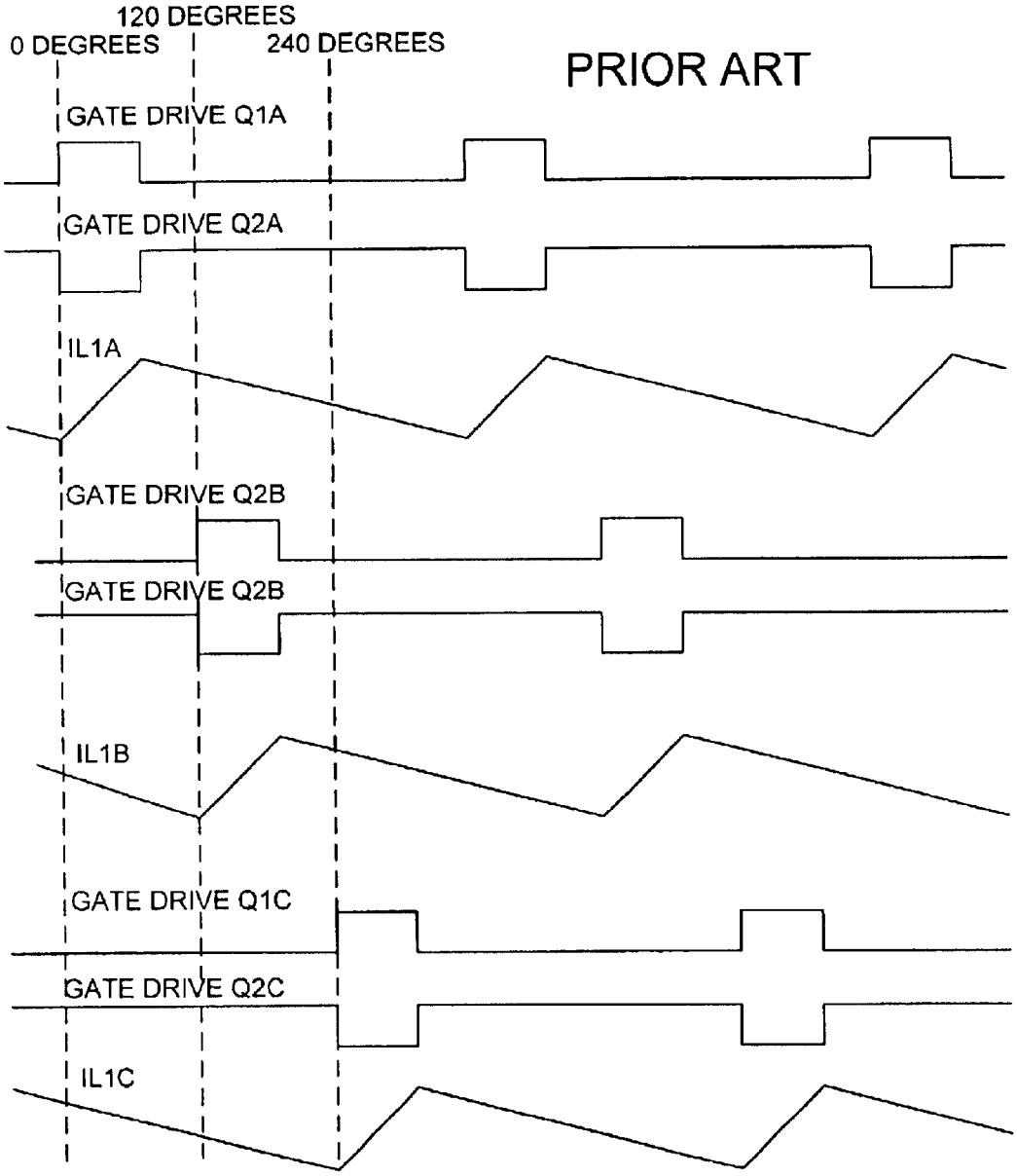
FIG. 3B is a timing diagram illustrating activation of multiple phases of the prior art phase redundant regulator apparatus of FIG. 3A.
Figure 4:
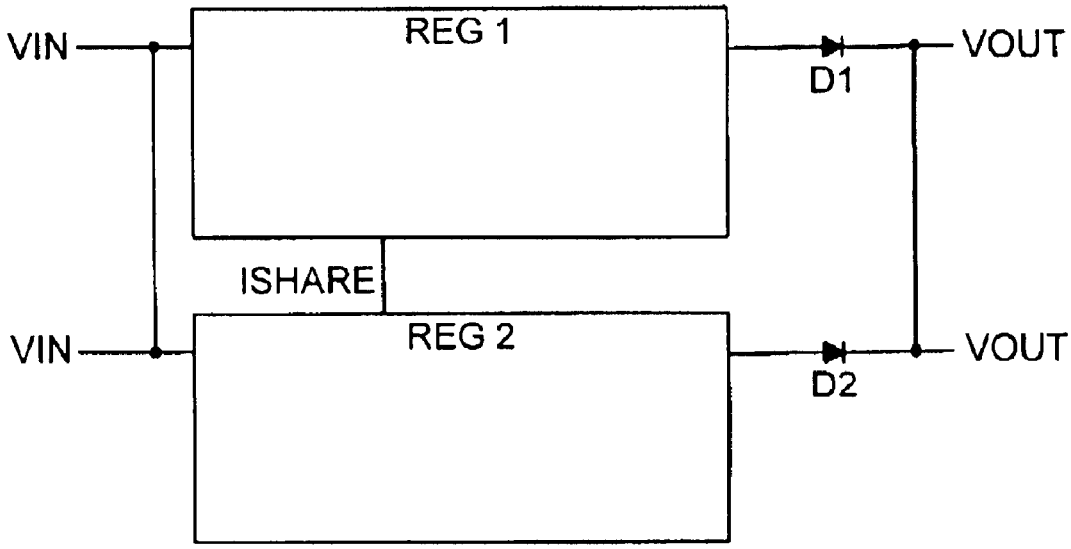
FIG. 4 is a schematic and block diagram representation illustrating a prior art output ORing arrangement for a conventional parallel multi-phase buck regulator arrangement.
Figure 5:
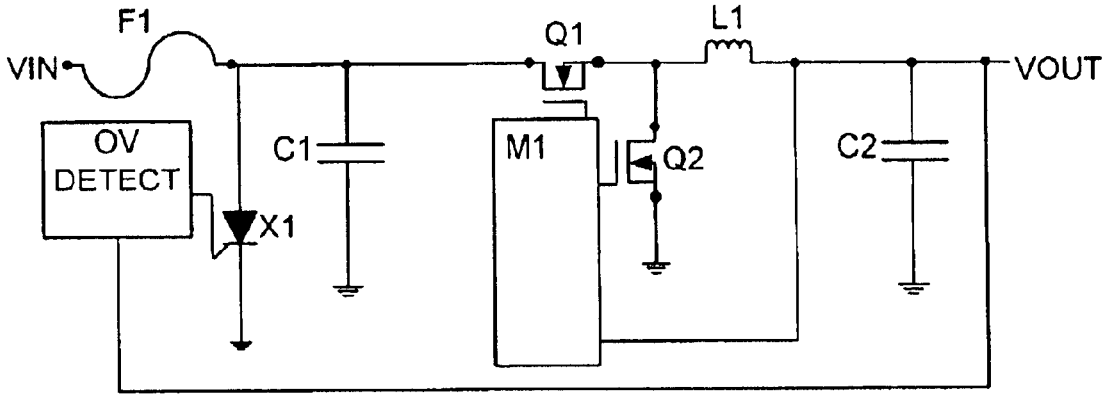
FIG. 5 is a schematic and block diagram representation illustrating a prior art protection circuit for a conventional buck regulator topology.
Figure 6:
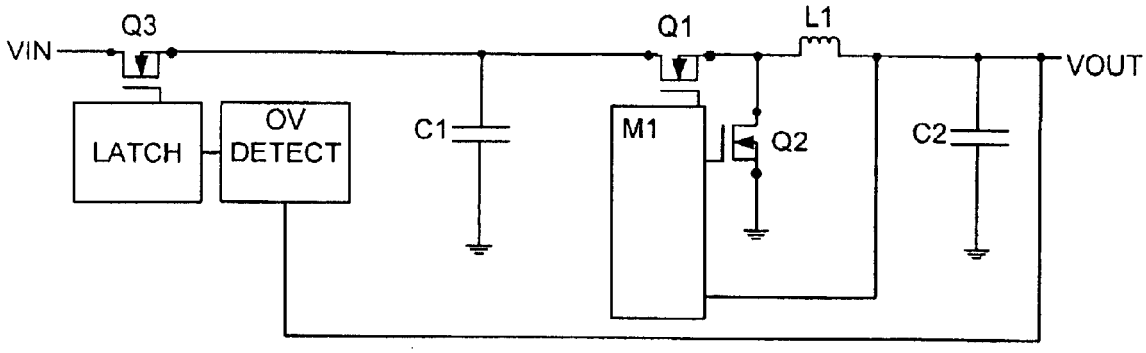
FIG. 6 is a schematic and block diagram representation illustrating another prior art protection circuit for a conventional buck regulator topology.

As illustrated in FIGS. 8 and 9, the signal CONTROL 1 is received by driver 126 and used to create a gate drive for FET 114 and a gate drive for FET 116. Each of the phases including phase 2, 104; phase 3, 106; through phase N, 108 has a similar driver 126 that create the gate drive signals for the regulator FETs. The current signals, CURRENT 1, CURRENT 2, CURRENT 3, and CURRENT N, are sent back to the multi-phase controller 110, which uses these inputs to adjust the signals, CONTROL 1 through CONTROL N to force current sharing between the phases, phase 1, 102; phase 2, 104; phase 3, 106; through phase N, 108. The multi-phase controller 110 controls phase as shown in the prior art arrangements of FIGS. 2, 3, and 4. It should be understood that the present invention is not limited to a particular multi-phase controller or control method. The implementation shown is FIG. 8 shows the driver 126 separate from the multi-phase controller 110. Where the prior art arrangements of FIGS. 2, 3, and 4 have the driver 126 integrated into the controller M1. For purposes of the present invention, various multi-phase controllers can be used, as long as the multi-phase controller implements a current share method that maintains current sharing between active phases when a phase fails.

Each of the multi-phases, phase 1, 102; phase 2, 104; phase 3, 106; and phase N, 108 includes an output ORing device generally designated by the reference character 130 that is used to prevent negative current into each respective phase buck regulator 112. The output ORing device 130 protects for shorts of the FET 116 and the output capacitor 124. The output ORing device 130 includes a comparator 132 and a field effect transistor (FET) 134 arranged to simulate a diode function. The output ORing device 130 could be implemented with an actual diode which by nature prevents negative current. Comparator 132 has inputs coupled across the FET 134 and an output connected to a gate of the FET 134. The current is detected in the ORing FET 134 by measuring the FET channel resistance voltage polarity and amplitude, and used by comparator 132 to turn off the FET 134 when negative current is detected or more than an allowed amount of negative current is reached. For better di/dt response some negative current can be helpful, so a threshold of acceptable negative current may be allowed.

Each of the multi-phases, phase 1, 102; phase 2, 104; phase 3, 106; and phase N, 108 includes an input FET 136 that is used for two reasons including input over current (OC) protection and output over voltage (OV) protection. A latch 138 provides a control input to a gate of the input FET 136 to turn off FET 136 in the event of either an input over current condition or an output over voltage condition. Latch 138 is coupled to an input over current protect circuit generally designated by reference character 140 and an output over voltage protect circuit generally designated by reference character 142.

Input over current protect circuit 140 is used to protect for shorts of the input capacitor 122 or other circuit failure that could over current the source voltage. Input over current protect circuit 140 includes an operational amplifier 144 that amplifies a voltage across the input FET 136 and provides an amplified voltage signal to a comparator 146. A resistor 148 is coupled between a first input and output of the operational amplifier 144. A first resistor 150 and a second resistor 152 are respectively connected between the first input and second input of the operational amplifier 144 and across the input FET 136. A third resistor 154 is connected between ground and the connection of the second resistor 152 and the second input of the operational amplifier 144. Current is detected in the resistance drain to source (RDSon) of the FET 136 with operational amplifier 144. If this current exceeds the over current trip point, comparator 146 trips and latches latch 138 that turns off input FET 136. Other methods of detection of current level through FET 136 could also be used, such as, a current sense resistor.

Output over voltage protect circuit 142 uses the input FET 136 to protect against the failure of FET 114. Without the output over voltage protect circuit 142, when FET 114 shorts this causes the output voltage to increase until it is at the input voltage level. This over voltage condition is not allowed with output over voltage protect circuit 142 using the input FET 136 for protection. This is accomplished two ways. Output over voltage protect circuit 142 includes a pair of comparators 160, 162, each providing an output applied to a respective input of a two-input OR gate 164.

Comparator 162 is used to monitor the output voltage of the phase, with a first input connected to VOUT of buck regulator 112 and a second reference input. If VOUT exceeds a set limit, comparator 162 trips and is applied via OR gate 164 to latch 138, causing input FET 136 to turn off.

Comparator 160 is used to monitor a volt-second product at the junction of FETs 114, 116, to provide an advance warning of an over voltage condition. A parallel connected diode 166 and resistor 168 are connected between the junction of FETs 114, 116 and a first input of comparator 160. A relatively small capacitor 170 as compared to output capacitor 124 is connected between ground and the connection of diode 166 and resistor 168 and the first input of comparator 160. A reference is applied to the second input of comparator 160. The volt-second product of resistor 168 and capacitor 170 normally is reset every switching cycle with diode 166 discharging capacitor 170, so that only a true failure of FET 114 would trip the volt-second comparator 160. The use of diode 166, resistor 168 and capacitor 170 allows the over voltage condition to be detected, for example, in only two to three cycles after FET 114 fails and much faster than inductor 118 and capacitor 124 allow the voltage to rise to cause an output over voltage. If the volt-second product exceeds the threshold of or the REF input of comparator 160, then comparator 160 trips which in turn latches latch 138 via gate 164 and shuts off the input FET 136.

Current detect 180 includes an operational amplifier 182 together with a plurality of resistors 183, 184, 185, and 186 to create a differential amplifier to sense the voltage across the resistor 120 of buck regulator 112. This sensed voltage is proportional to the current in resistor 120. The current detect operational amplifier 182 of each respective phase buck regulator 112 provides the respective phase current signal to the multi-phase controller 110. The multi-phase controller 110 controls N number of phases and remains a critical point of failure in multi-phase regulator system 100. This multi-phase controller 110 provides a current share method that allows for the failure of at least one phase and maintains current sharing between the non-failed phases.

In accordance with features of the preferred embodiment, a first advantage this gives is cost, where redundancy between 100 amp regulators costs an additional 100 amp regulator, a phase redundant design with four 25 amp phases would only require a fifth 25 amp phase for phase-redundancy.

Multi-phase regulator system 100 includes a number N of phases, for example, N-1 or N-2 phases providing a desired system capacity with one or two of the N phases providing phase redundancy. For example, to provide a system capacity of 90 amps, multi-phase redundant regulator system 100 could be implemented with four 30 amp phases with three 30 amp phases satisfying the required system capacity of 90 amps and a fourth 30 amp phase providing phase-redundancy. That is any one of the four amp phases can fail and the remaining three 30 amp phases remain effective to satisfy the 90 amp system capacity.

A second advantage is to use the redundant phase for masked-redundancy. By use of the redundant phase for masked-redundancy means that when a phase fails, the fault is not reported, and the redundant phase is used to create a high reliability regulator instead of a redundant one.

Assume for example, a standard multi-phase regulator has a reliability of 10 M (where M is million hours) mean time between failure (MTBF) hours and 5% of these failures are in the multi-phase control chip. By implementing phase redundancy 95% of the single points of failures of the regulator are removed. The remaining 5% critical fails gives you 200M MTBF critical failure rate of the control module and 10.5M*10.5M for the rest of the regulator. This basically leaves only the critical failure rate of the control module for a total 200M MTBF and provides a 20×improvement in reliability assuming that the control module makes up for 5% of the total regulator failure rate. The reliability typically will be higher than this example, due to the control module making up well less than 5% of the failure rate.

In many cases conventional multi-phase buck regulators are being embedded into processor cards and backplanes. So the failure rate of a conventional multi-phase buck regulator is very important, but for cost reasons known conventional multi-phase buck regulators are not used redundantly. Advantages of placing the regulator on the processor card are reduction of decoupling capacitors, reduction in distribution cost, better regulation and processor performance. But placing the regulator on the processor card has the disadvantage of creating a critical failure risk that will cause a more expensive assembly to be replaced if the regulator fails and is not redundant. Conventional redundant regulators need to be plugged into distribution systems and wired to the processor cards which requires more decoupling capacitors.

The multi-phase phase redundancy implementation of the preferred embodiment enables the advantages of the on-card regulator design, and also provides the redundancy or high reliability to avoid critical failures. With phase redundancy of the preferred embodiment the required number of decoupling capacitors is also reduced, which will reduce the number of critical failures, that is failure of the decoupling capacitors. A case can be made that the critical failure rate with phase redundancy of the preferred embodiment is less than the critical failure rate of the decoupling capacitors it can displace. Meaning that the multi-phase phase redundancy implementation of the preferred embodiment may be not only more reliable, but also more available than conventional redundant regulators when the other critical component failures that have been removed by allowing on-card regulators are taken into account.

While the present invention has been described with reference to the details of the embodiments of the invention shown in the drawing, these details are not intended to limit the scope of the invention as claimed in the appended claims.

What is claimed is:

1. A phase redundant regulator apparatus comprising:

a plurality of regulator phases connected in parallel between a regulator input and a regulator output; each of said plurality of regulator phases including a regulator receiving an input voltage and providing an output voltage;

a multi-phase controller coupled to each of said plurality of regulator phases; said multi-phase controller receiving a feedback output voltage and a respective detected current signal from each of said plurality of regulator phases;

said multi-phase controller generating control signals to sequentially activate each of said plurality of regulator phases for predetermined periods of time to generate controlled current sharing between phases; and each of said plurality of regulator phases including an output ORing device to limit current flow into each said phase;

an input protection device for providing input over current protection and output over voltage protection of each said phase; and said multi-phase controller implementing a current sharing method for maintaining current sharing between all active phases after a failure of one or more of said plurality of regulator phases with one or more of said regulator phases provided for enabling redundancy.

2. A phase redundant regulator apparatus as recited in claim 1 wherein said regulator includes a buck regulator.

3. A phase redundant regulator apparatus as recited in claim 1 wherein said multi-phase controller generates control signals to sequentially activate each of said plurality of regulator phases to generate controlled master slave current sharing of said plurality of regulator phases.

4. A phase redundant regulator apparatus as recited in claim 1 wherein said output ORing device to limit current flow into each said phase includes a field effect transistor coupled between an output of said regulator and said regulator output; and a comparator having inputs coupled across said field effect transistor and providing a gate control input to said field effect transistor to limit current flow into each said phase.

5. A phase redundant regulator apparatus as recited in claim 1 wherein said input protection device for providing input over current protection and output over voltage protection of each said phase includes an input field effect transistor coupled between an input of said regulator and said regulator input; and a latch providing a gate control input to said input field effect transistor for providing input over current protection and output over voltage protection of each said phase.

6. A phase redundant regulator apparatus as recited in claim 5 includes an over current protect circuit for detecting an input over current condition and providing a control signal to said latch for turning off said input field effect transistor.

7. A phase redundant regulator apparatus as recited in claim 6 wherein said over current protection circuit includes an operational amplifier having inputs coupled across said input field effect transistor and providing an amplified signal output applied to a first input of a comparator; a reference applied to a second input of said comparator; said comparator providing said control signal to said latch for turning off said input field effect transistor responsive to said amplified signal output above said reference.

8. A phase redundant regulator apparatus as recited in claim 5 includes an over voltage protect circuit for detecting an output over voltage condition and providing a control signal to said latch for turning off said input field effect transistor.

9. A phase redundant regulator apparatus as recited in claim 8 wherein said over voltage protection circuit includes a comparator having said output voltage of said regulator phase applied to a first input and a reference applied to a second input; and said comparator providing said control signal to said latch for turning off said input field effect transistor responsive to said output voltage of said regulator phase above said reference.

10. A phase redundant regulator apparatus as recited in claim 8 wherein said over voltage protection circuit includes a comparator having a detected volt-second product at a junction of a pair of controlled transistor within said regulator and a reference applied to a second input; and said comparator providing said control signal to said latch for turning off said input field effect transistor responsive to said detected volt-second product above said reference.

11. A phase redundant regulator apparatus as recited in claim 10 includes said first input connected to a parallel connected diode and resistor connected between said junction of said pair of controlled transistor and a capacitor connected between ground and said first input; said volt-second product of said resistor and said capacitor normally being reset each switching cycle with said capacitor discharged through said diode.

12. A phase redundant regulator apparatus as recited in claim 8 wherein said over voltage protection circuit includes a first comparator monitoring said output voltage of said regulator phase, and a second comparator monitoring a volt-second product at a junction of a pair of controlled transistor within said regulator; said first comparator and said second comparator coupled to said latch by an OR gate for providing said control signal to said latch for turning off said input field effect transistor responsive to said monitored output voltage or said monitored volt-second product above a threshold level.

13. A method for implementing redundancy at a phase level with a phase redundant regulator apparatus including a plurality of regulator phases connected in parallel between a regulator input and a regulator output with at least one of said plurality of regulator phases provided for enabling redundancy; each of said plurality of regulator phases including a regulator receiving an input voltage and providing an output voltage and each of said plurality of regulator phases including an output ORing device to limit current flow into each said phase: and an input protection device for providing input over current protection and output over voltage protection of each said phase; said method comprising the steps of:

providing a multi-phase controller coupled to each of said plurality of regulator phases; said multi-phase controller receiving a feedback output voltage and a respective detected current signal from each of said plurality of regulator phases;

generating control signals to sequentially activate each of said plurality of regulator phases for predetermined periods of time to generate controlled current sharing between said plurality of regulator phases with said multi-phase controller; and said controlled current sharing output current for said plurality of regulator phases being maintained by said plurality of regulator phases with a failed one of said plurality of regulator phases.

14. A method for implementing redundancy at a phase level with a phase redundant regulator apparatus as recited in claim 13 wherein the step of generating control signals to sequentially activate each of said plurality of regulator phases for predetermined periods of time to generate controlled current sharing output current for said plurality of regulator phases includes generating control signals for sequentially activating each of said plurality of regulator phases to generate controlled master slave current sharing of said plurality of regulator phases.

15. A phase redundant regulator apparatus comprising:

a plurality of regulator phases connected in parallel between a regulator input and a regulator output; each of said plurality of regulator phases including a regulator receiving an input voltage and providing an output voltage;

a multi-phase controller coupled to each of said plurality of regulator phases; said multi-phase controller receiving a feedback output voltage and a respective detected current signal from each of said plurality of regulator phases;

said multi-phase controller generating control signals to sequentially activate each of said plurality of regulator phases for predetermined periods of time to generate controlled current sharing between phases; and each of said plurality of regulator phases including an output ORing field effect transistor coupled between an output of said regulator and said regulator output; and a comparator having inputs coupled across said output ORing field effect transistor and providing a gate control input to said output ORing field effect transistor to limit current flow into each said phase;

an input protection field effect transistor coupled between an input of said regulator and said regulator input; and a latch providing a gate control input to said input field effect transistor for providing input over current protection and output over voltage protection of each said phase; and said multi-phase controller implementing a current sharing method for maintaining current sharing between all active phases after a failure of one or more of said plurality of regulator phases with one or more of said regulator phases provided for enabling redundancy.

16. A phase redundant regulator apparatus as recited in claim 15 wherein said multi-phase controller generates control signals to sequentially activate each of said plurality of regulator phases to generate controlled master slave current sharing of said plurality of regulator phases.

17. A phase redundant regulator apparatus as recited in claim 15 includes an over current protect circuit for detecting an input over current condition and providing a control signal to said latch for turning off said input field effect transistor.

18. A phase redundant regulator apparatus as recited in claim 17 wherein said over current protect circuit includes an operational amplifier having inputs coupled across said input field effect transistor and providing an amplified signal output applied to a first input of a comparator; a reference applied to a second input of said comparator; said comparator providing said control signal to said latch for turning off said input field effect transistor responsive to said amplified signal output above said reference.

19. A phase redundant regulator apparatus as recited in claim 15 includes an over voltage protect circuit for detecting an output over voltage condition and providing a control signal to said latch for turning off said input field effect transistor.

20. A phase redundant regulator apparatus as recited in claim 19 wherein said over voltage protect circuit includes a first comparator monitoring said output voltage of said regulator phase, and a second comparator monitoring a volt-second product at a junction of a pair of controlled transistor within said regulator; said first comparator and said second comparator coupled to said latch by an OR gate for providing said control signal to said latch for turning off said input field effect transistor responsive to said monitored output voltage or said monitored volt-second product above a threshold level.

* * * * *